US008649151B2

(12) United States Patent
Yamada et al.

(10) Patent No.: US 8,649,151 B2
(45) Date of Patent: Feb. 11, 2014

(54) INJECTOR DRIVE CIRCUIT

(75) Inventors: Shigeki Yamada, Hitachinaka (JP); Takuya Mayuzumi, Hitachinaka (JP); Mitsuhiko Watanabe, Odawara (JP); Ayumu Hatanaka, Naka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 66 days.

(21) Appl. No.: 13/363,414

(22) Filed: Feb. 1, 2012

(65) Prior Publication Data

US 2012/0194961 A1 Aug. 2, 2012

(30) Foreign Application Priority Data

Feb. 2, 2011 (JP) ..... 2011-020296

(51) Int. Cl.
*H01H 47/00* (2006.01)
*F02M 51/00* (2006.01)

(52) U.S. Cl.
USPC ..... 361/152; 123/490

(58) Field of Classification Search
USPC ..... 351/152; 123/490; 361/152
See application file for complete search history.

(56) References Cited

U.S. PATENT DOCUMENTS 5,717,562 A * 2/1998 Antone et al. ..... 361/155
5,975,057 A 11/1999 Repplinger et al.
6,407,593 B1 * 6/2002 Kawamoto et al. ..... 327/110
6,721,158 B2 4/2004 Heinke
6,766,789 B2 * 7/2004 Yamakado et al. ..... 123/490
7,057,870 B2 * 6/2006 Meyer et al. ..... 361/139
8,018,216 B2 * 9/2011 Kakehi ..... 323/288
8,214,132 B2 * 7/2012 Bunni et al. ..... 701/106
2002/0179059 A1 12/2002 Aoki et al.
2008/0289607 A1 11/2008 Mayuzumi et al.
2009/0183714 A1 7/2009 Mayuzumi
2009/0243574 A1 10/2009 Mayuzumi et al.
2010/0242920 A1 9/2010 Omori et al.
2011/0022202 A1 1/2011 Lundback et al.
2011/0220067 A1 9/2011 Okonogi et al.
2011/0220069 A1 9/2011 Hatanaka et al.

FOREIGN PATENT DOCUMENTS

DE 199 63 154 A1 6/2001
EP 1 179 670 A1 2/2002
EP 1 944 492 A2 7/2008
JP 2008-169762 A 7/2008

OTHER PUBLICATIONS

European Search Report dated Jul. 31, 2012.

* cited by examiner

*Primary Examiner* — Scott Bauer
(74) *Attorney, Agent, or Firm* — Crowell & Moring LLP

(57) ABSTRACT

An injector drive circuit including: a step-up circuit generating a high voltage from a power supply; a first switching device connected to a path between the step-up circuit and an injector; a second switching device connected to the power supply; a third switching device connected between the injector and the ground; and a control unit operating the first, second and third switching device according to a value of current flowing through the injector; wherein the control unit has a unit turning on and off the second switching device in a period during which it turns on and off the first switching device a plurality of times; wherein the control unit has, as set values to control the current flowing through the injector, a first threshold defining a lower current limit, a second threshold defining an upper current limit and a third threshold, larger than the second threshold.

1 Claim, 6 Drawing Sheets

INJECTOR DRIVE CIRCUIT

BACKGROUND OF THE INVENTION

The present invention relates to an injector drive circuit.

Conventional internal combustion engine control devices for automobiles, motorcycles, agricultural machines, machine tools and ship machinery using gasoline and light oil as fuel have injectors that directly inject fuel into cylinders to improve fuel consumption and output. Such injectors are called "in-cylinder direct injection type injectors", "direct injector" or "DI".

Current mainstream gasoline engines employ a port injection system that injects fuel into an intake manifold. An engine with the in-cylinder direct injection type injectors using highly pressurized fuel requires higher energy during an injector valve opening operation than does the port injection system. To improve controllability to cope with faster revolutions, high energy must be supplied to the injectors in a short period of time. Further, in engines with the in-cylinder direct injection type injectors, attention is being focused on a technology called a multiple injection which is designed to reduce fuel cost and exhaust emissions. This technology, however, is required to supply high energy to the injectors in an even shorter period of time because the same amount of fuel that is injected once in one stroke of the conventional piston needs to be injected in several divided portions at different timings.

Many injector drive circuits to control the in-cylinder direct injection type injectors generally have a step-up circuit that boosts a battery voltage to a higher voltage that is applied to the injectors to reduce their response time. So, in the multiple injection technology that has an increased number of injector operations, a burden on the step-up circuit increases, making it an important issue to reduce the load of the step-up circuit.

Now, a typical current waveform of the direct injector will be explained. First, during a peak current application period at an initial stage of injector energization, the injector current is raised to a predetermined peak current in a short period of time using a stepped-up voltage to open an injector valve. This peak current, when compared with the injector current in the system that injects fuel into an intake manifold, is about 5-20 times higher. After the peak current application period ends, the source of energy supply to the injector changes from the step-up circuit to the battery power, supplying a lower current than the peak current to keep the injector valve open. By supplying the peak current and the valve open state holding current, the open injector injects fuel into the cylinder.

At the end of fuel injection, the injector current must be cut off to quickly close the injector valve by lowering the injector-energizing current in a short time. The injector, however, has high energy stored therein by the injector current flowing through it. So, it is necessary to eliminate this energy from the injector. To accomplish this in a short period of time, various kinds of methods are used, including one which transforms the energy into thermal energy by a switching device in an injector current application circuit utilizing a Zener diode effect and one which, through a current regeneration diode, regenerates the injector current to a step-up capacitor that stores the boosted voltage from the step-up circuit.

JP-A-2008-169762, for example, discloses a technology that controls a current flowing through the injector by simultaneously energizing the step-up circuit and the battery drive circuit, both as energy supply sources.

SUMMARY OF THE INVENTION

The injector drive circuit disclosed in JP-A-2008-169762 sets upper and lower limits on the injector current for repetitively turning on and off the current application. In a normal operation, when the injector current reaches the upper limit, the injector drive circuit turns off a first switching device and, when the current falls to the lower limit, turns it on again. With this repetitive on/off operation of the switching device, the current flowing through the injector is maintained between the upper and lower limits.

However, there is a problem to be addressed. Consider a case where, after first and second switching devices have been turned on simultaneously, the current flowing through the injector rises from 0 and reaches the upper limit, at which time the first switching device in the step-up circuit is turned off. If at this time a power supply voltage increases for some reason, current that is being fed into the injector through the second switching device causes the current flowing through the injector to continue to rise even after the first switching device has been turned off. In this situation the injector current cannot be controlled because the current has already exceeded the upper limit.

That is, the current flowing through the injector can no longer be controlled between the upper and lower limits, making it difficult to achieve the control objective of keeping the injector valve opening at a predetermined position, degrading the controllability.

The injector drive circuit of this invention can reduce the load of the step-up circuit and thereby perform a stable control on the injector current.

One preferred aspect of the present invention to solve the aforementioned problem is as follows.

The injector drive circuit of the present invention includes:

a step-up circuit to generate a high voltage from a power supply;

a first switching device connected to a path between the step-up circuit and one of terminals of an injector;

a second switching device connected to a positive electrode of the power supply;

a first diode connected to a path between a negative electrode side of the second switching device and the one terminal of the injector;

a second diode having one of its terminals connected between the one terminal of the injector and the first diode and its other terminal connected to the ground;

a third switching device connected to a path between the other terminal of the injector and the ground; and a control unit to operate the first switching device, the second switching device and the third switching device according to a value of current flowing through the injector;

wherein the control unit has a unit to turn on and off the second switching device during a period in which it turns on and off the first switching device a plurality of times;

wherein the control unit has, as set values to control the current flowing through the injector, a first threshold defining a lower limit of the current, a second threshold defining an upper limit of the current and a third threshold, higher than the second threshold.

With this invention, a stable injector current control can be performed.

Other objects, features and advantages of the invention will become apparent from the following description of the embodiments of the invention taken in conjunction with the accompanying drawings.

DESCRIPTION OF THE EMBODIMENTS

Figure 1:
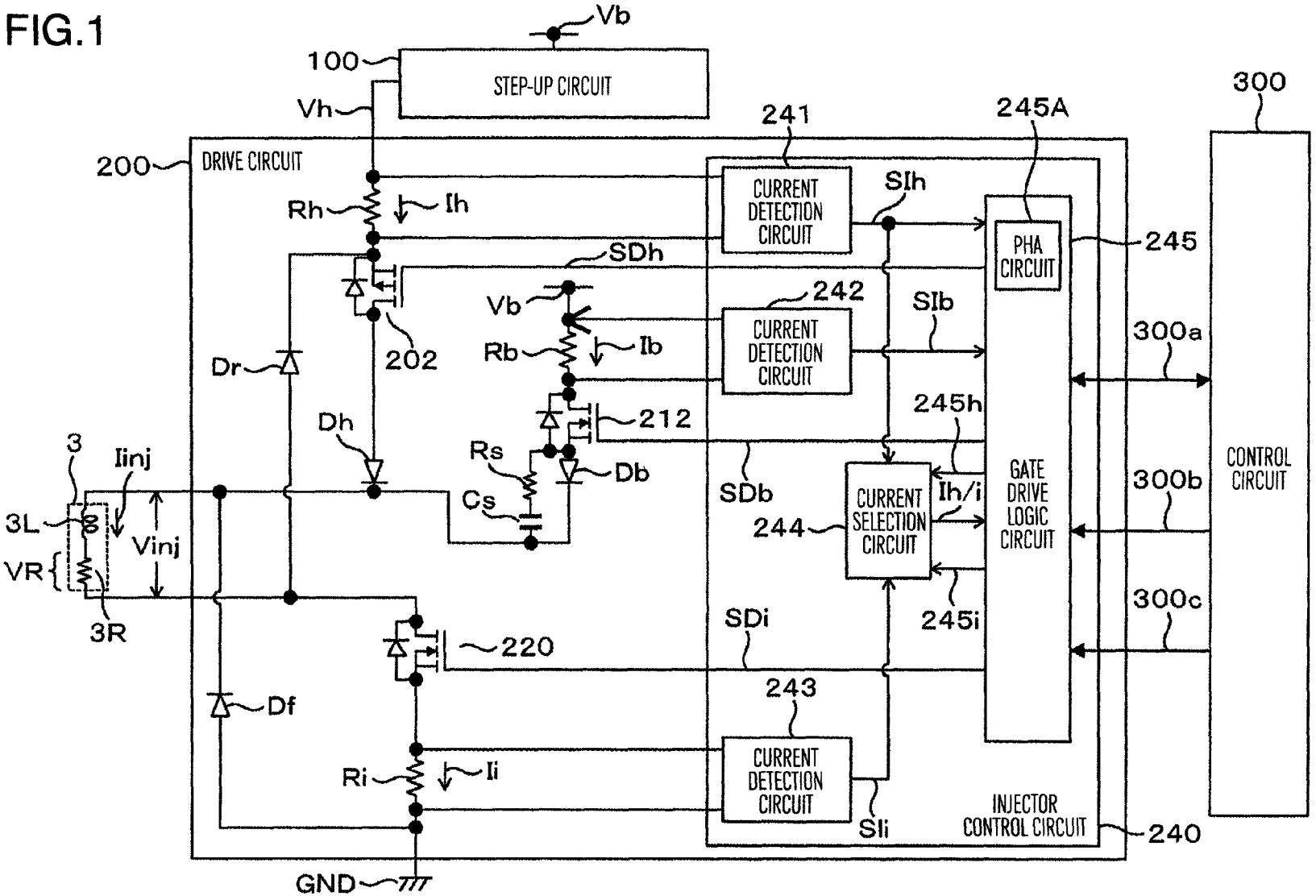
FIG. 1 is a block diagram showing the construction of an injector control system using an injector drive circuit according to a first embodiment of this invention.
Figure 2:
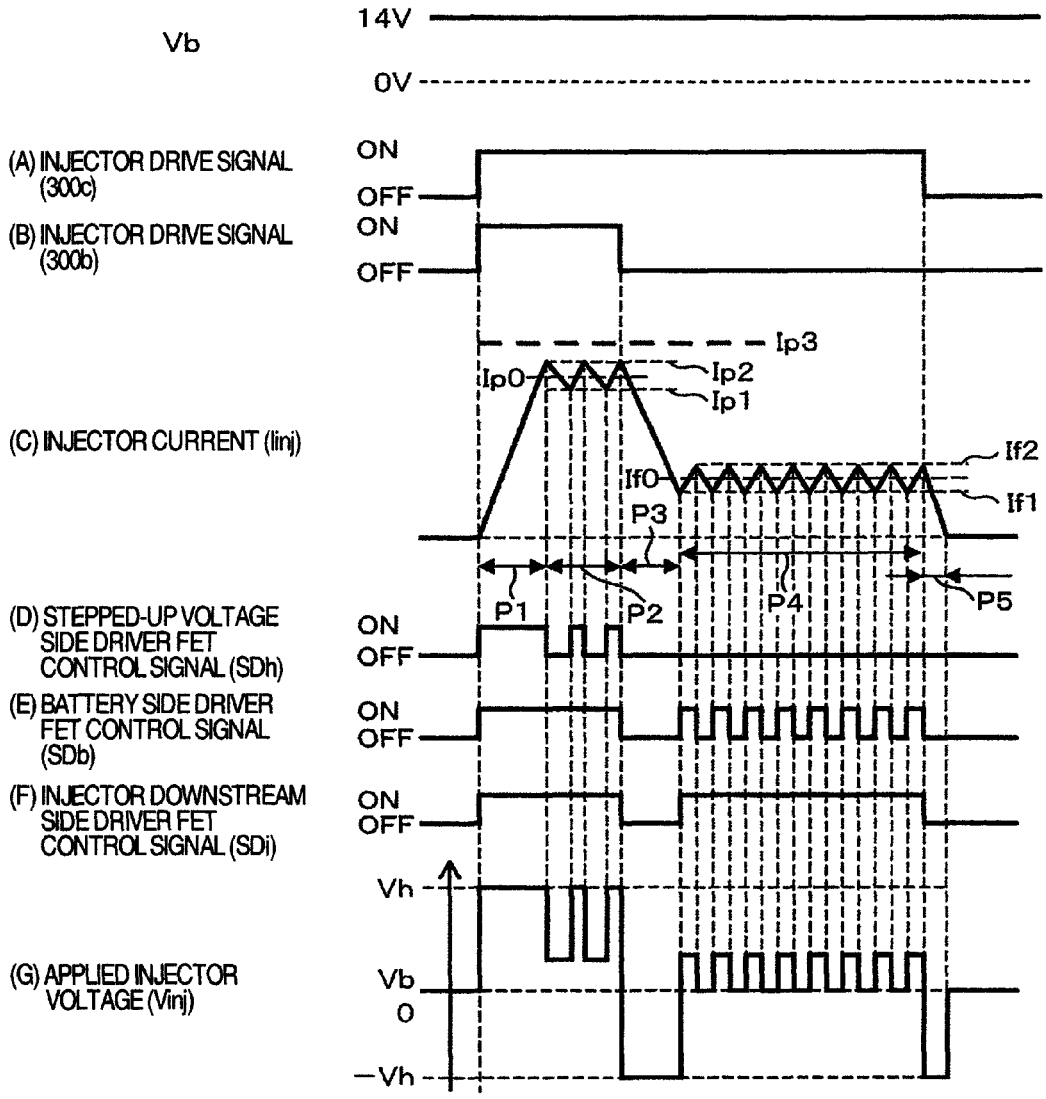
FIG. 2 is a timing chart showing the operation of the injector control system using the injector drive circuit according to the first embodiment of this invention.

Referring to FIG. 1 and FIG. 2, the construction and operation of an injector drive circuit according to the first embodiment of this invention will be explained.

First, referring to FIG. 1, the construction of an injector control system using the injector drive circuit of this embodiment will be explained. Although an in-cylinder direct injection type injector is taken up as an example, this invention is also applicable to other injectors using a step-up circuit. Further, while the injector drive circuit is shown here to drive one injector, it can also drive two or more injectors.

The injector drive circuit of this invention has a step-up circuit 100 and a drive circuit 200.

The drive circuit 200 controls the supply of power to an injector 3 based on a control command from a control circuit 300. The control circuit 300 comprises an engine control unit and others and controls the supply of electricity to the injector 3 according to the state of a vehicle and to a driver's intention. The injector 3 is a direct injector. The injector 3 is applied a stepped-up voltage Vh boosted by the step-up circuit 100 or a voltage Vb from a battery.

The injector 3 can be represented by an equivalent circuit consisting of an internal coil 3L and an internal parasitic resistor 3R, connected in series. Generally, the in-cylinder direct injection type injector has a parasitic resistance of a few ohms (Ω).

The step-up circuit 100 is shared by a plurality of drive circuits 200. Normally, one to four step-up circuits 100 are mounted in one engine. The number of drive circuits 200 that share these step-up circuits 100 is determined by such factors as a peak current application starting period (P1 in FIG. 2 described later) and a peak current holding period (P2 in FIG. 2 described later) of an injector current Iinj described later, a voltage rising period—which is determined by the energy required to drive the injector, the engine's top revolution speed and the number of multiple fuel injections for one combustion in the same cylinder—and a self-heating of the step-up circuit 100.

The step-up circuit 100 boosts the battery power voltage Vb up to a stepped-up voltage Vh. If the battery voltage Vb is 12V for example, the stepped-up voltage Vh is about 65V.

The stepped-up voltage Vh boosted by the step-up circuit 100 is supplied to the upstream side of the injector 3 through a stepped-up voltage side current detection resistor Rh, a stepped-up voltage side driver FET 202 and a stepped-up voltage side protection diode Dh. The stepped-up voltage side current detection resistor Rh converts a stepped-up voltage side drive current Ih into voltage to detect an overcurrent flowing out of the step-up circuit 100 or a harness break on the injector 3 side. The stepped-up voltage side driver FET 202 is driven during the peak current application starting period P1 and the peak current holding period P2 of the injector current Iinj described later. The stepped-up voltage side protection diode Dh blocks the reverse current flowing in the event of a failure of the step-up circuit 100.

Also connected to the upstream side of the injector 3 through a battery side current detection resistor Rb, a battery side driver FET 212 and a battery side protection diode Db is the voltage Vb of the battery power supply. The battery side current detection resistor Rb converts the battery side drive current Ib into voltage to detect an overcurrent from the battery power supply or a harness break on the injector 3 side. The battery side protection diode Db prevents a current from the stepped-up voltage Vh from flowing back to the battery power supply. A snubber circuit of series-connected resistor Rs and capacitor Cs is connected in parallel with the battery side protection diode Db.

The battery side driver FET 212 is generally driven during a valve open state holding current application period (P4 in FIG. 2 described later) to apply the injector valve open state holding current. In this embodiment, it is also used to alleviate a current fall during the peak current holding period P2 as described later.

To the downstream side of the injector 3 is connected an injector downstream side driver FET 220. The on/off operation of the injector downstream side driver FET 220 determines whether the injector is energized or deenergized. In this example, the injector current Iinj that has passed through the injector 3 flows to the ground GND through a downstream side current detection resistor Ri, connected to a source electrode of the injector downstream side driver FET 220. The terms "downstream" or "upstream" used in the description means "downstream" ("upstream") of flow in an electric current.

A free wheeling diode Df is connected between the ground GND and the upstream side of the injector 3. The free wheeling diode Df is used to free-wheel an injector-regenerated current that is produced by shutting off the stepped-up voltage side driver FET 202 and the battery side driver FET 212 simultaneously and turning on the injector downstream side driver FET 220 while the injector current Iinj is applied. For this purpose, the anode of the free wheeling diode Df is connected to the ground GND and the cathode to the upstream side of the injector 3.

The current regeneration diode Dr is provided between the downstream side and the stepped-up voltage side of the injector 3. In this example, the anode of the current regeneration diode Dr is connected to a path between the injector 3 and the injector downstream side driver FET 220 and its cathode is connected to a path between the stepped-up voltage side current detection resistor Rh and the stepped-up voltage side driver FET 202. The current regeneration diode Dr is used to regenerate the electric energy of the injector 3 to the step-up circuit 100 by shutting off all of the stepped-up voltage side driver FET 202 and the battery side driver FET 212 on the upstream side of the injector 3 and the injector downstream side driver FET 220 while the injector current Iinj is applied. The regeneration of the injector current is done when it is desired to quickly attenuate the applied injector current, as when closing the injector valve.

The stepped-up voltage side driver FET 202, the battery side driver FET 212 and the injector downstream side driver FET 220 are controlled by an injector valve opening signal 300*b* and an injector drive signal 300*c* generated by the control circuit 300 according to the engine revolution speed and other input conditions from various sensors. The injector valve opening signal 300*b* and the injector drive signal 300*c* are fed to a gate drive logic circuit 245 of an injector control circuit 240 in the drive circuit 200. The control circuit 300 and the gate drive logic circuit 245 communicate with each other using a communication signal 300*a* to update necessary information.

The injector control circuit 240 has a stepped-up voltage side current detection circuit 241, a battery side current detection circuit 242, a downstream side current detection circuit 243, a current selection circuit 244 and a gate drive logic circuit 245. The stepped-up voltage side current detection circuit 241 detects the stepped-up voltage side drive current Ih flowing through the stepped-up voltage side current detection resistor Rh. The battery side current detection circuit 242 detects the battery side drive current Ib flowing through the battery side current detection resistor Rb. The downstream side current detection circuit 243 detects the downstream side drive current Ii flowing through the downstream side current detection resistor Ri. The current selection circuit 244 selects one of the currents detected by the stepped-up voltage side current detection circuit 241 and the downstream side current detection circuit 243.

When it receives a stepped-up voltage side current selection signal 245*h* from the gate drive logic circuit 245, the current selection circuit 244 selects the current detected by the stepped-up voltage side current detection circuit 241 and, when it receives an injector downstream side current selection signal 245*i* from the logic circuit 245, selects the current detected by the downstream side current detection circuit 243 and outputs it as a selected signal Ih/i.

The gate drive logic circuit 245 generates a stepped-up voltage side driver FET control signal SDh, a battery side driver FET control signal SDb and an injector downstream side driver FET control signal SDi based on detected values (a stepped-up voltage side current detection signal SIh, a battery side current detection signal SIb and an injector downstream side current detection signal SIi) detected by the stepped-up voltage side current detection circuit 241, the battery side current detection circuit 242 and the downstream side current detection circuit 243. The control circuit 300 and the injector control circuit 240 communicates necessary information through the communication signal 300*a* between the drive circuit 200 and the control circuit 300 to realize a satisfactory operation of the injector. The necessary information includes a peak current upper limit (Ip2 in FIG. 2 described later) that determines the injector drive waveform, a peak current lower limit (Ip1 in FIG. 2 described later), a valve open state holding current upper limit (If2 in FIG. 2 described later), a valve open state holding current lower limit (If1 in FIG. 2 described later), a peak current holding period P2, a valve open state holding current application period P4, a presence or absence of the peak current, a peak current holding operation, a switching of peak current lowering speed between sharp and moderate rates, a valve opening current holding operation, an overcurrent detection, a broken wire detection, an overheat protection, a step-up circuit failure diagnosis and a control signal for the injector control circuit 240.

As described in JP-A-2008-169762, the current detection resistors may be connected at a variety of positions and, according to the manner of their connections, the form of the current detection circuit and the current selection circuit varies. This embodiment is also applicable to these circuit variations.

Next, referring to FIG. 2, the operation of the injector control system using the injector drive circuit of this embodiment will be explained.

FIG. 2 is a timing chart showing the operation of the injector control system using the injector drive circuit according to one embodiment of this invention.

In FIG. 2 the abscissa represents time. The ordinate of FIG. 2(A) represents the injector drive signal 300*c*, the ordinate of FIG. 2(B) the injector valve opening signal 300*b*, and the ordinate of FIG. 2(C) the injector current Iinj. The ordinate of FIG. 2(D) represents a stepped-up voltage side driver FET control signal SDh, the ordinate of FIG. 2(E) a battery side driver FET control signal SDb, the ordinate of FIG. 2(F) an injector downstream side driver FET control signal SDi, and the ordinate of FIG. 2(G) an applied injector voltage.

The waveform of the injector current Iinj shown at FIG. 2(C) can be divided into five sections: a peak current application starting period P1, a peak current holding period P2, a transition-to-valve-open-state-holding-current period P3, a valve open state holding current application period P4 and an applied current lowering period P5.

First, when the injector drive signal 300*c* turns on as shown in FIG. 2(A) and the injector valve opening signal 300*b* turns on as shown in FIG. 2(B), the peak current application starting period P1 initiates. During this period P1, the stepped-up voltage Vh boosted by the step-up circuit 100 raises the injector current Iinj to a predetermined peak current upper limit Ip2 in a short time. At this time, the gate drive logic circuit 245, as shown at FIGS. 2(D) and (F), outputs the stepped-up voltage side driver FET control signal SDh and the injector downstream side driver FET control signal SDi to turn on both the stepped-up voltage side driver FET 202 and the injector downstream side driver FET 220. As a result, as shown at FIG. 2(C), the applied injector voltage Vinj is raised to the stepped-up voltage Vh causing the injector current Iinj to change sharply from zero to the peak current upper limit Ip2. The stepped-up voltage Vh actually falls about 1 [V] due to the voltage drop in the stepped-up voltage side protection diode Dh. During this period P1, although the battery side driver FET control signal SDb may take either of two states, on or off, it is shown at FIG. 2(E) to be turned on as an example.

During this period P1, the injector downstream side current selection signal 245*i* is controlled to turn on and the stepped-up voltage side current selection signal 245*h* to turn off. So, the current selection circuit 244 selects the injector downstream side current detection signal SIi output from the downstream side current detection circuit 243. As a result, the injector downstream side current detection signal SIi based on the downstream side drive current Ii flowing through the downstream side current detection resistor Ri is the selected signal Ih/i.

When the injector current Iinj reaches the predetermined peak current upper limit Ip2, the peak current holding period P2 begins. At this time, the stepped-up voltage side driver FET control signal SDh is controlled to be turned on and off repetitively to hold the injector current between the peak current lower limit Ip1 and the peak current upper limit Ip2. During this period, the applied injector voltage Vinj is raised to the stepped-up voltage Vh intermittently.

During the peak current holding period P2, to lower the injector current Iinj from the peak current upper limit Ip2 to the peak current lower limit Ip1, both the battery side driver FET control signal SDb and the injector downstream side driver FET control signal SDi are turned on, as shown at FIGS. 2(E) and (F), to turn on both the battery side driver FET 212 and the injector downstream side driver FET 220. At the same time, the stepped-up voltage side driver FET control signal SDh is turned off, as shown at FIG. 2(D), to turn off the stepped-up voltage side driver FET 202. This causes the applied injector voltage Vinj to fall to the battery voltage Vb (actually 1 [V] lower than Vb due to the voltage drop in the battery side protection diode Db), thus alleviating the current fall (this method is called a "peak hold assist method"). A peak hold assist (PHA) circuit 245A executes the peak hold assist method.

When the injector current Iinj reaches the peak current lower limit Ip1, the gate drive logic circuit 245 again turns on the stepped-up voltage side driver FET control signal SDh, as shown at FIG. 2(D), to turn on the stepped-up voltage side driver FET 202. This causes the injector current Iinj to rise, as shown at FIG. 2(C). By repeating the on/off operation of the stepped-up voltage side driver FET control signal SDh, the injector current Iinj is controlled between the peak current lower limit Ip1 and the peak current upper limit Ip2.

If we let an average current of the peak current upper limit Ip2 and the peak current lower limit Ip1 be a peak current Ip0, the injector current Iinj during the peak current holding period P2 is held on average at the peak current Ip0.

The above peak hold assist method reduces the frequency of the operation that raises the injector current from the peak current lower limit Ip1 to the peak current upper limit Ip2 during the peak current holding period P2 using the step-up circuit, which in turn reduces the load of the step-up circuit.

FIG. 2 shows the peak current lower limit Ip1 and the peak current upper limit Ip2 as the upper and lower thresholds for current control (current controlling thresholds). In addition to these upper and lower thresholds, this invention provides a current control threshold Ip3, which is larger than the peak current upper limit Ip2. The reason for the provision of this threshold will be explained by referring to FIG. 3 and subsequent figures.

Figure 3:
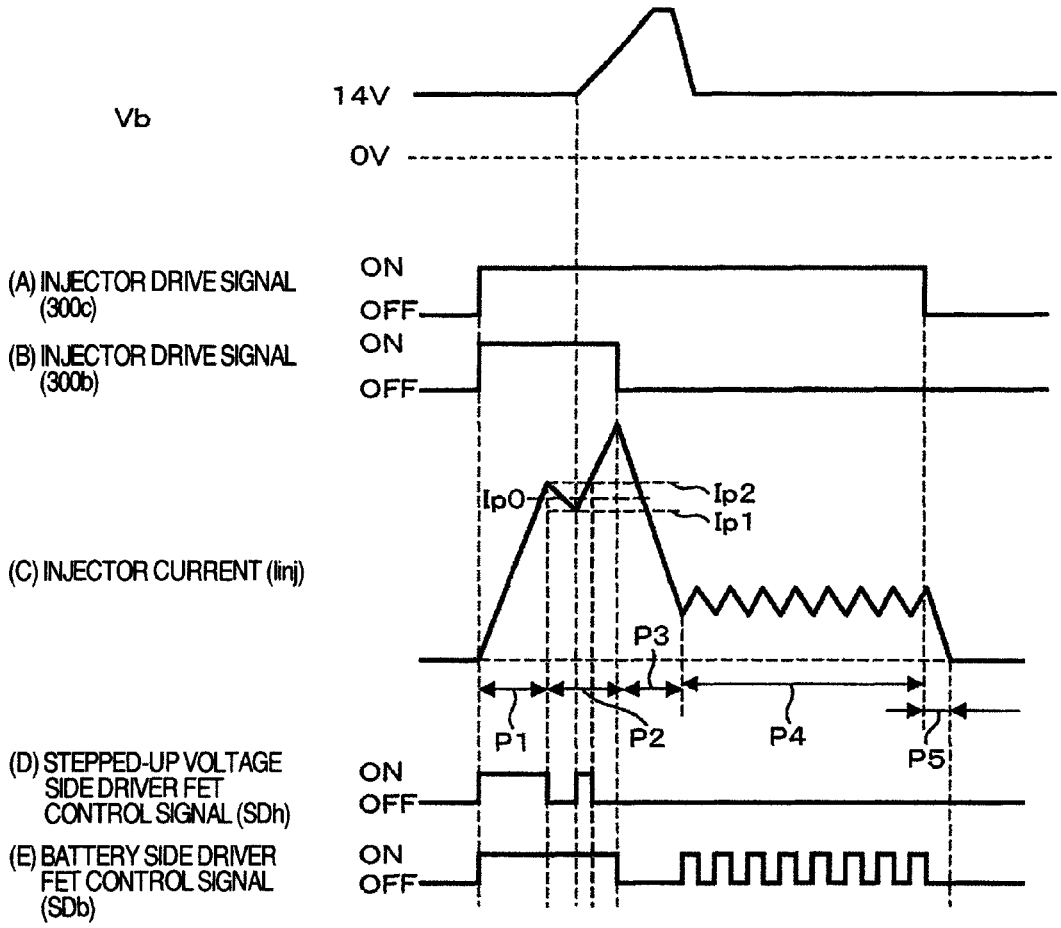
FIG. 3 is a timing chart of the injector control system during an abnormal condition.

FIG. 3 is a timing chart showing a case where the battery voltage Vb rises during a period when the injector current Iinj is controlled between the peak current lower limit Ip1 and the peak current upper limit Ip2.

As shown at FIGS. 3(D) and (E), the stepped-up voltage side driver FET control signal SDh and the battery side driver FET control signal SDb are both turned on, causing the injector current Iinj to start rising from 0. When the injector current reaches the peak current upper limit Ip2, the stepped-up voltage side driver FET control signal SDh turns off, lowering the injector current Iinj down to the peak current lower limit Ip1. Then the stepped-up voltage side driver FET control signal SDh turns on again, causing the injector current Iinj to begin to rise again. If at this timing the battery voltage Vb increases, the injector current Iinj rises higher and reaches the peak current upper limit Ip2, at which time the stepped-up voltage side driver FET control signal SDh turns off. But because the battery voltage Vb has increased, the injector current Iinj continues to rise in a region higher than the peak current upper limit Ip2.

In this state, the injector current Iinj can no longer be controlled within a predetermined range, resulting in degraded controllability.

Such an increase in the battery voltage can happen in the event of an alternator failure or when a battery terminal gets dislocated while the engine is running.

Figure 4:
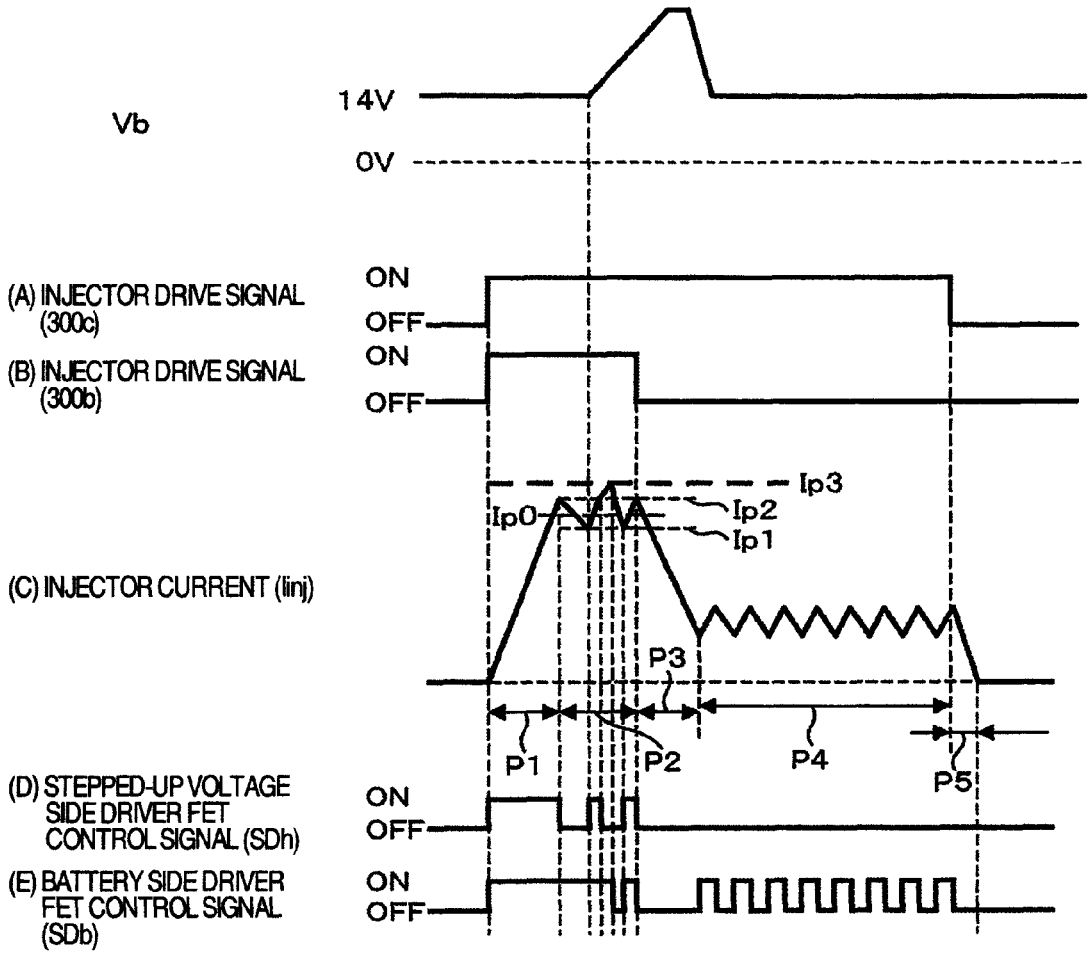
FIG. 4 is a timing chart showing the operation of the injector control system using an injector drive circuit according to another embodiment of this invention.

FIG. 4 is a timing chart when a current control threshold Ip3, higher than the peak current upper limit Ip2, is used in addition to the peak current upper limit Ip2 in order to ensure that a stable control can be performed even in the case described above.

While a control is carried out to keep the current between the peak current upper limit Ip2 and the peak current lower limit Ip1, if the injector current Iinj reaches the current control threshold Ip3, the battery side driver FET control signal SDb is turned off, as shown at FIG. 4(E), to lower the injector current Iinj.

That is, in the peak current holding period P2 during which a control is performed to keep the current constant by using the current control threshold Ip3, larger than the peak current upper limit Ip2, if the injector current Iinj reaches the current control threshold Ip3, the battery side driver FET control signal SDb is stopped to control the injector current Iinj within a predetermined range.

Figure 5:
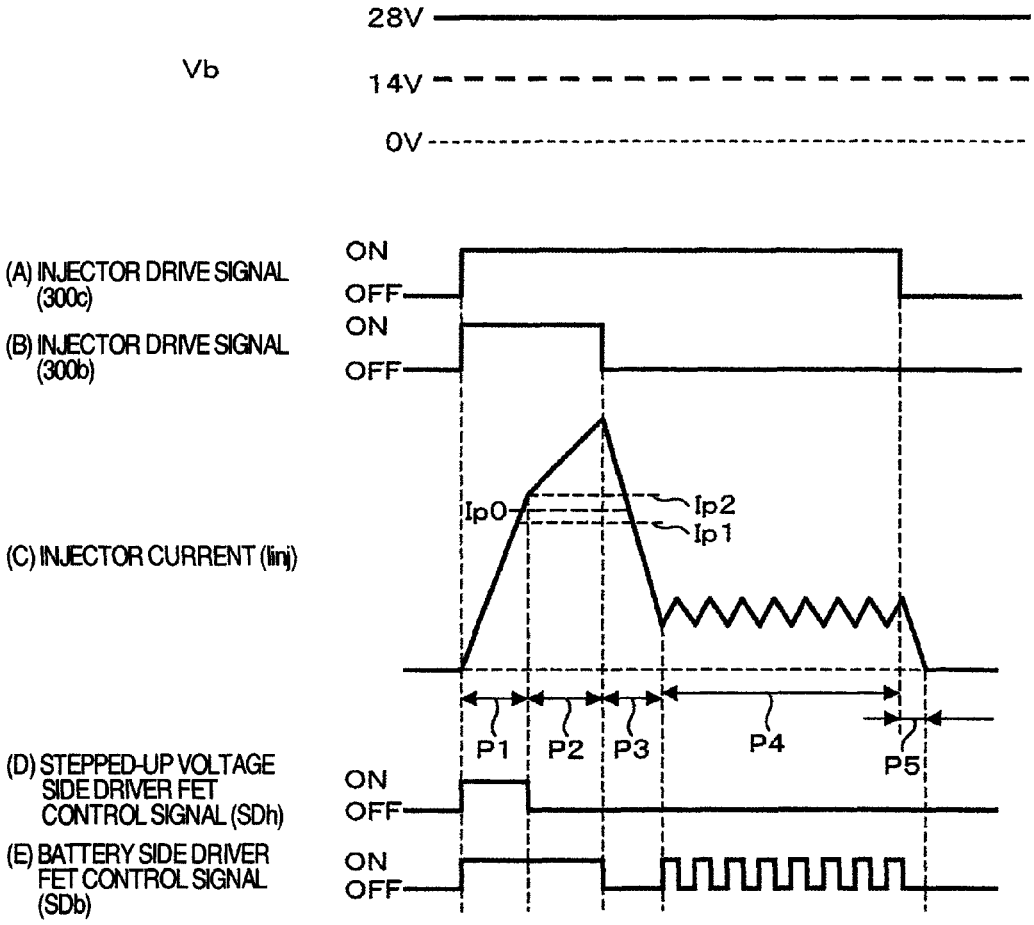
FIG. 5 is a timing chart of the injector control system during an abnormal condition.

FIG. 5 is a timing chart when the battery voltage Vb is 28 V, double the ordinary 14 V shown in FIG. 2 to FIG. 4.

The battery voltage Vb rises to 28 V as when batteries are connected in series (jump start mode) to secure an enough voltage to start the engine in a cold district where the batteries easily run out of electricity.

As shown at FIGS. 5(D) and (E), when the stepped-up voltage side driver FET control signal SDh and the battery side driver FET control signal SDb both turn on, the injector current Iinj begins to rise. When the injector current Iinj reaches the peak current upper limit Ip2, the stepped-up voltage side driver FET control signal SDh turns off. However, since the battery side driver FET control signal SDb is still on, the injector current Iinj continues to rise.

Figure 6:
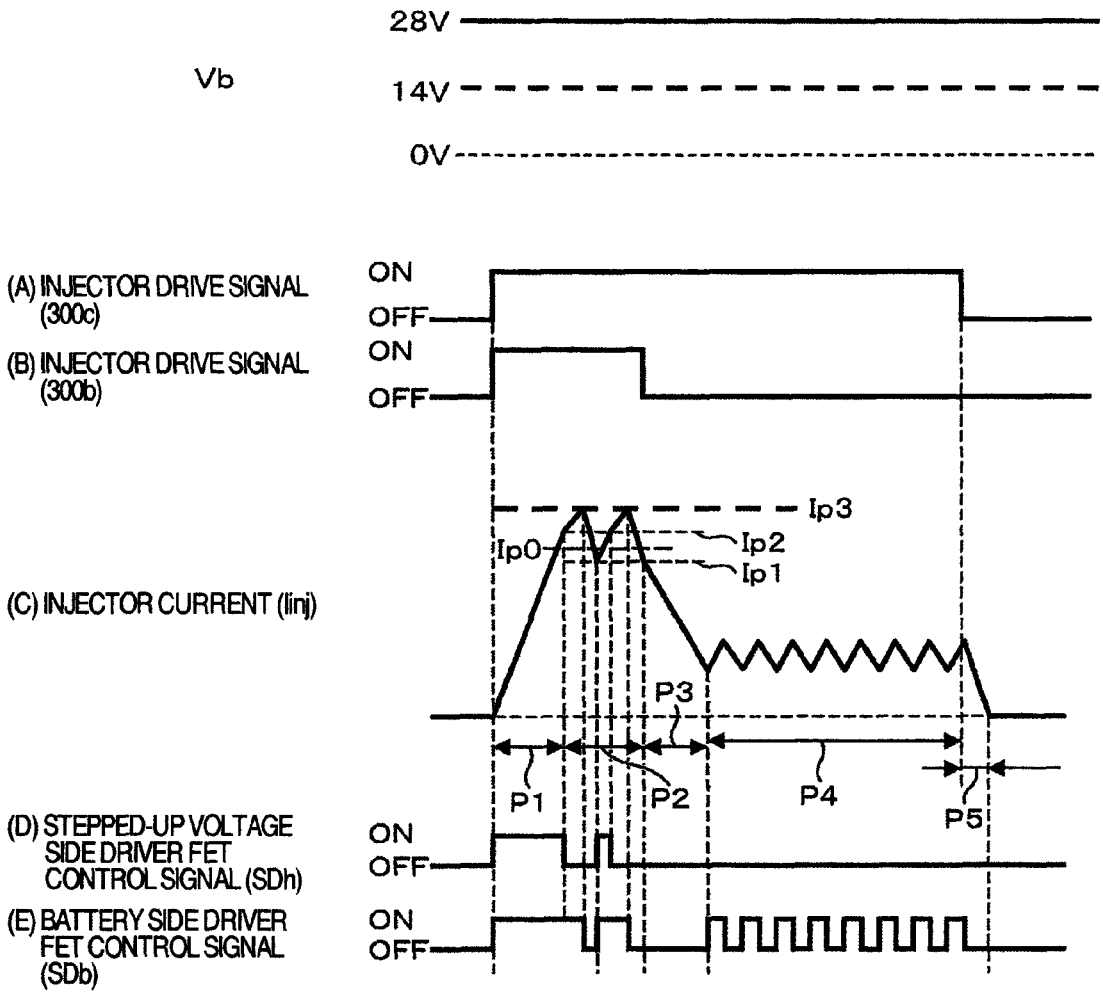
FIG. 6 is a timing chart showing the operation of the injector control system using an injector drive circuit according to still another embodiment of this invention.

FIG. 6 is a timing chart when the current control threshold Ip3, higher than the peak current upper limit Ip2, is used to prevent the aforementioned situation.

As in FIG. 4, if, in the peak current holding period P2 during which a control is performed to keep the injector current Iinj constant, the injector current Iinj reaches the current control threshold Ip3, the battery side driver FET control signal SDb is stopped, as shown at FIG. 6(E), to prevent the injector current Iinj from rising above the current control threshold Ip3.

By setting the current control threshold Ip3 at a slightly higher value than the peak current upper limit Ip2, it is possible to perform the current control almost similar to that using the peak current upper limit Ip2.

It is noted that, during the peak current holding period P2, the use of the peak hold assist method may result in the injector current rising, rather than falling to the peak current lower limit Ip1, depending on the parasitic resistance in the injector being driven. That is, when the relation between the voltage drop VR caused by the peak current flowing through the parasitic resistor 3R and the applied injector voltage Vinj is VR>Vinj, the injector current decreases whereas, when the relation is VR<Vinj, the injector current increases.

Even in such a situation, the use of the current control threshold Ip3 assures a stable current control.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An injector drive circuit comprising:

a step-up circuit to generate a high voltage from a power supply;

a first switching device connected to a path between the step-up circuit and one of terminals of an injector;

a second switching device connected to a positive electrode of the power supply;

a first diode (Db) connected to a path between a negative electrode side of the second switching device and the one terminal of the injector;

a second diode (Df) having one of its terminals connected between the one terminal of the injector and the first diode and its other terminal connected to the ground;

a third switching device connected to a path between the other terminal of the injector and the ground; and a control means for operating the first switching device, the second switching device and the third switching device according to a value of current flowing through the injector;

wherein the control means includes a means for turning on and off the second switching device during a period in which it turns on and off the first switching device a plurality of times;

wherein the control means has, as set values to control the current flowing through the injector, a first threshold defining a lower limit of the current, a second threshold defining an upper limit of the current and a third threshold, higher than the second threshold, wherein the control means turns on and off the first switching device a plurality of times to control the value of current flowing through the injector between the first threshold and the second threshold, and wherein in a period during which the control means turns on and off the first switching device to hold the current flowing through the injector between the first threshold and the second threshold, if the current flowing through the injector rises above the second threshold and reaches the third threshold while the first switching device is off and the second switching device is on, the control means turns off the second switching device.

* * * * *